US006901921B1

(12) United States Patent
Barnett

(10) Patent No.: US 6,901,921 B1
(45) Date of Patent: Jun. 7, 2005

(54) CROSSBOW WITH INSET FOOT CLAW

(75) Inventor: David A. Barnett, Wolverhampton (GB)

(73) Assignee: Barnett International, Odessa, FL (US)

( * ) Notice: Subject to any disclaimer, the term of this patent is extended or adjusted under 35 U.S.C. 154(b) by 0 days.

(21) Appl. No.: 10/769,428

(22) Filed: Jan. 30, 2004

(51) Int. Cl.[7] ..... F41B 5/12
(52) U.S. Cl. ..... 124/25
(58) Field of Search ..... 124/25, 86

(56) References Cited

U.S. PATENT DOCUMENTS 2,842,114 A * 7/1958 Duncan ..... 124/25
3,269,380 A * 8/1966 Stevens ..... 124/25
4,860,719 A * 8/1989 Scheiterlein ..... 124/25
5,092,308 A * 3/1992 Sheffield ..... 124/25
5,119,797 A * 6/1992 Anderson ..... 124/25
6,651,641 B1 * 11/2003 Bower et al. ..... 124/25

* cited by examiner

*Primary Examiner*—John A. Ricci
(74) *Attorney, Agent, or Firm*—Carlton Fields, P.A.

(57) ABSTRACT

A crossbow having a stock with opposed longitudinal ends including a forward end to which is mounted a bow and a rearward end for engaging the shoulder of a user, includes a foot stirrup mounted to the stock forward end and interposed between the stock forward end and the bow, such that a user's foot is insertable into such stirrup to support the crossbow for cocking.

5 Claims, 3 Drawing Sheets

CROSSBOW WITH INSET FOOT CLAW

BACKGROUND OF THE INVENTION

This invention relates generally to a crossbow having a foot stirrup for use in cocking the crossbow, which foot stirrup is inset behind the bow prod.

Crossbows conventionally have included a foot stirrup for use in cocking. This is necessary so that the user can place his foot in the stirrup to hold the front of the crossbow against the ground while the user pulls the bow string back to a cocked position with his or her hands. Such prior art stirrups have conventionally extended out the front end of the stock of the crossbow, thus being positioned forward of the bow prods. For many users, particularly those who are tall, such an arrangement is satisfactory, in that they can bend over the crossbow stock and pull the string into the cocked position. However, some users of shorter stature have experienced difficulty in bending over the combined length of the crossbow stock and the forwardly projecting stirrup to grasp the string for cocking. For this reason, it has become desirable to develop a crossbow structure in which the combined length of the crossbow stock and the foot stirrup is shorter than the conventional arrangements.

SUMMARY OF THE INVENTION

In view of the foregoing, it is an object of the present invention to provide a crossbow in which the overall length, including the foot stirrup, is reduced. To achieve this and other objects of the invention that will become apparent to those skilled in the art, this invention provides a crossbow having a stock with opposed longitudinal ends, including a forward end to which is mounted a bow and a rearward for engaging the shoulder of the user and a foot stirrup mounted to the stock forward end and being interposed between the stock forward end and the bow, such that a user's foot is insertable into the stirrup to support the crossbow for cocking.

BRIEF DESCRIPTION OF THE DRAWINGS

A particularly preferred embodiment of the invention will be of this apparatus will be described in detail below in connection with the drawings in which.

DESCRIPTION OF PREFERRED EMBODIMENTS

Figure 1:
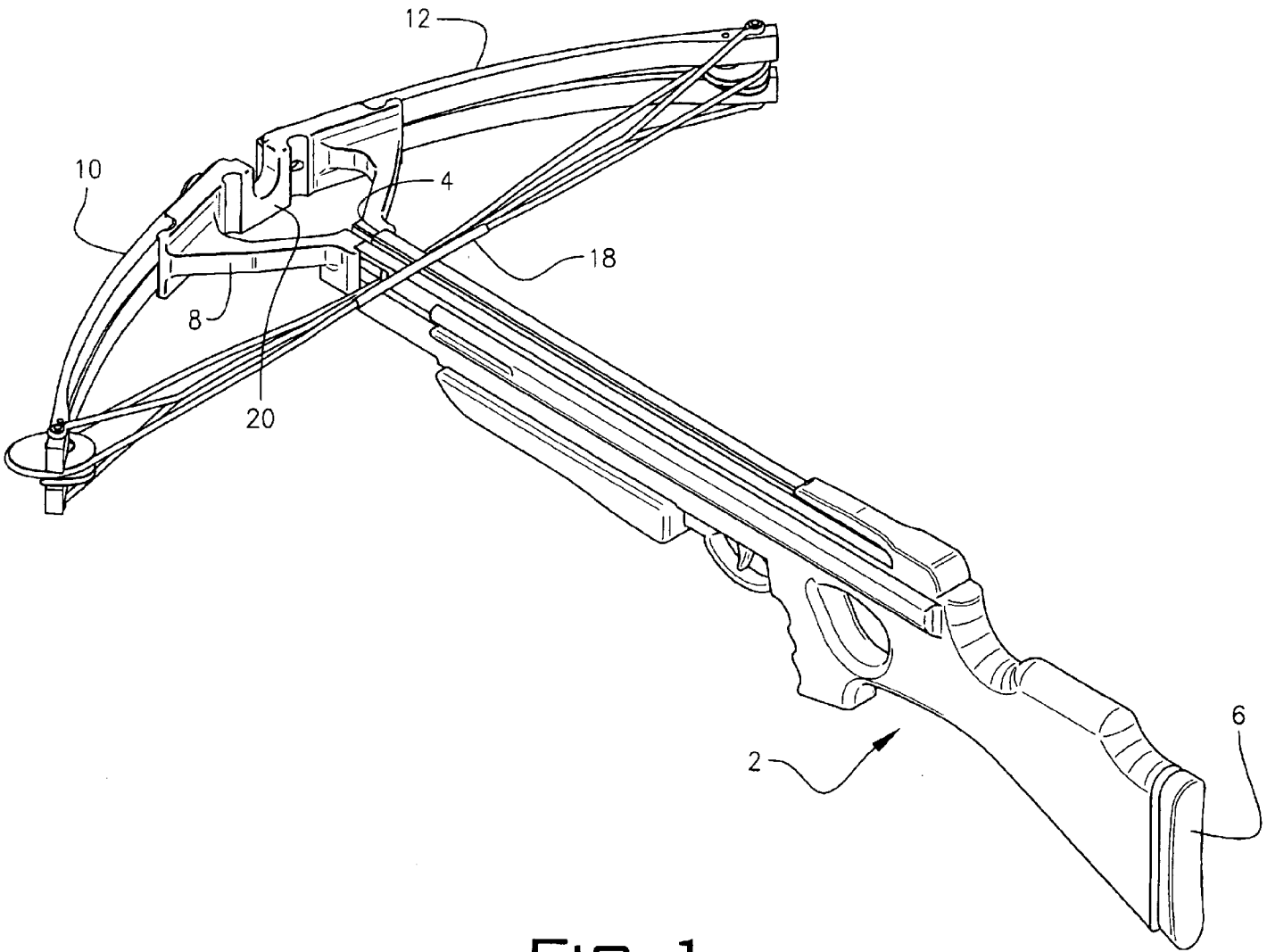
FIG. 1 is a rear perspective view of one embodiment of the invention.
Figure 2:
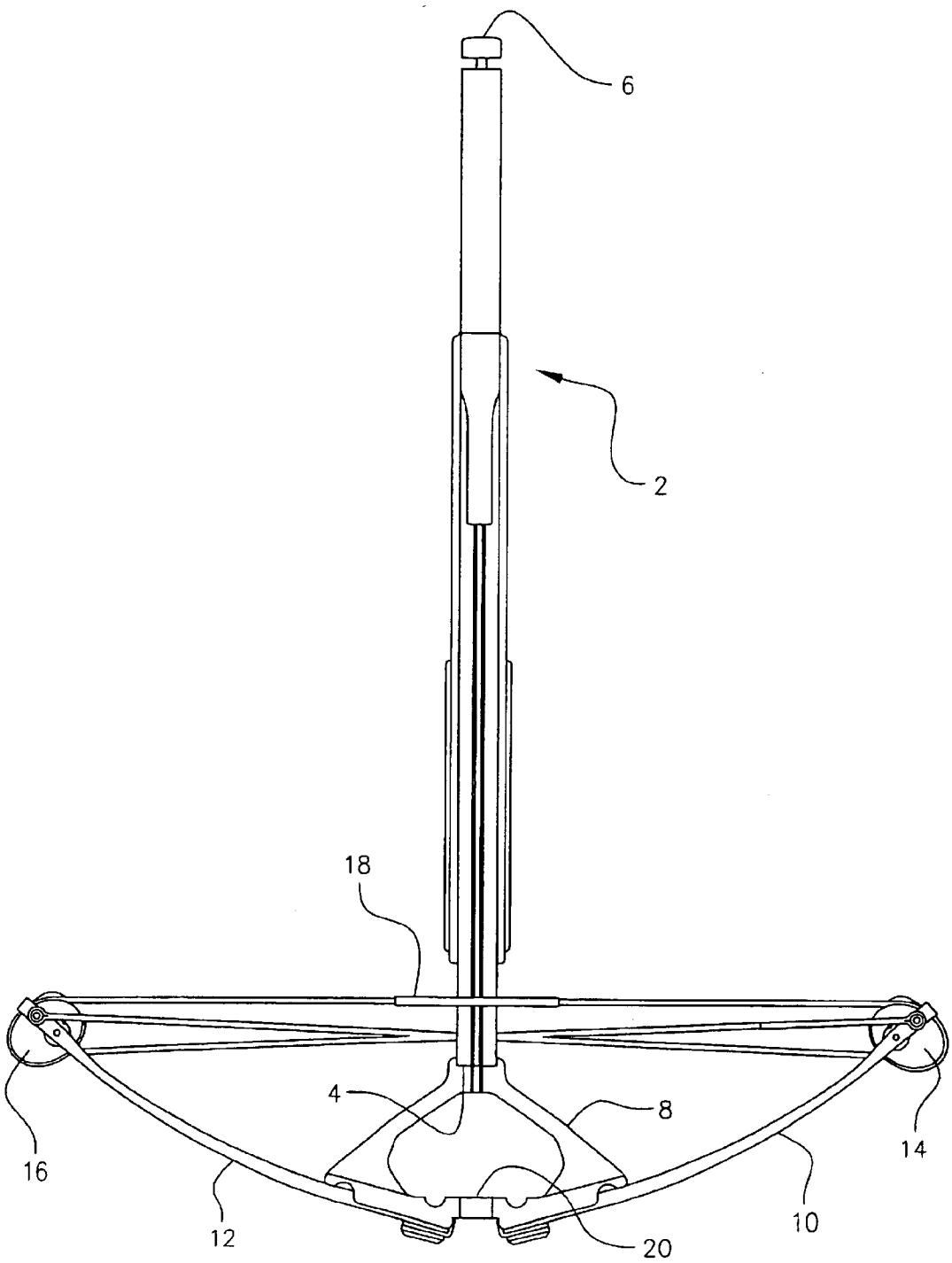
FIG. 2 is a top view of the apparatus of FIG. 1.
Figure 3:
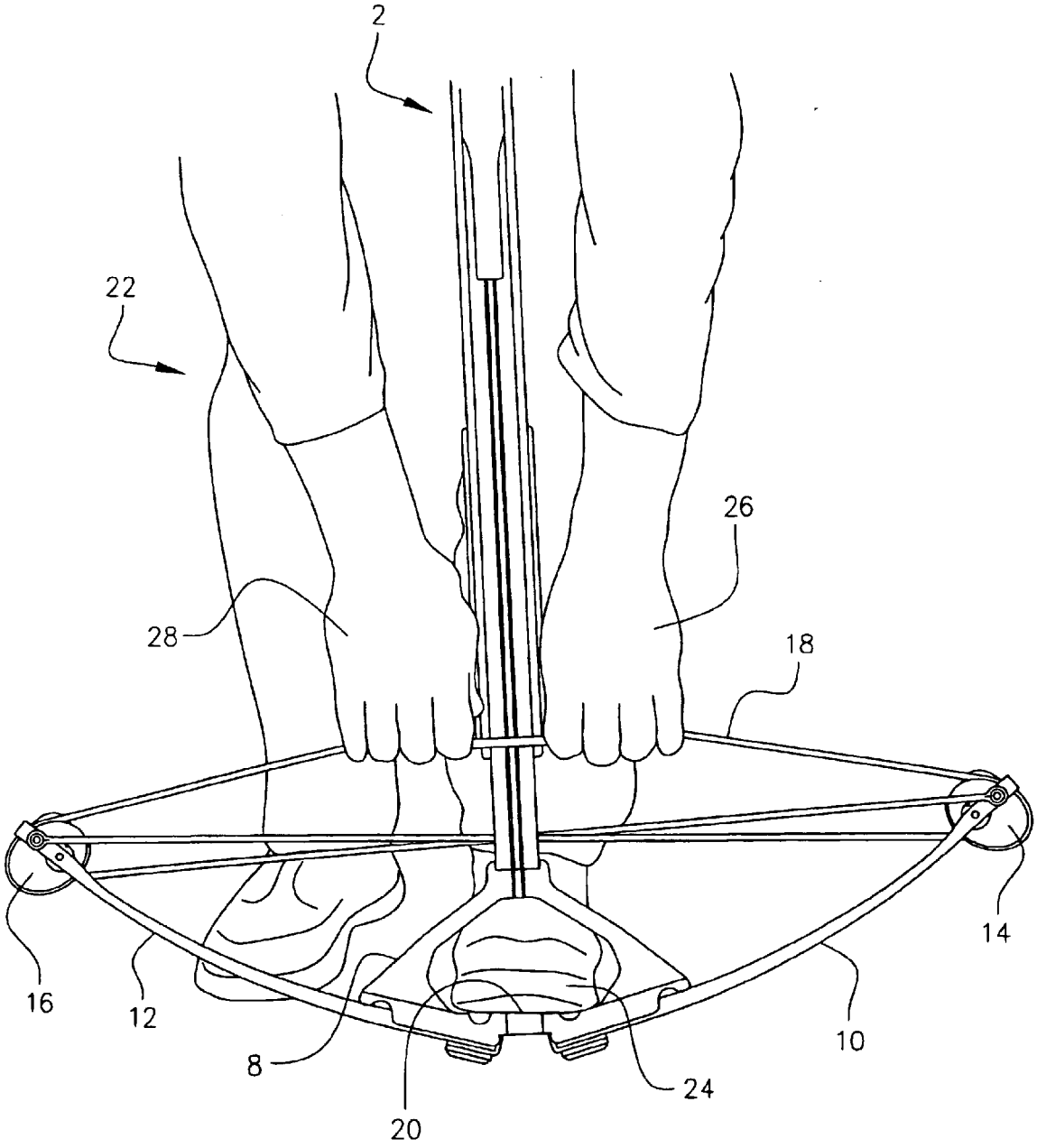
FIG. 3 is a fragmentary view of the apparatus of FIG. 1, illustrating the manner in which a user cocks the string of the crossbow apparatus.

A preferred embodiment of the crossbow of the present invention is illustrated in FIGS. 1 through 3. FIG. 1 is a rear perspective view of such a crossbow, in which reference numeral 2 refers generally to the stock of the crossbow, which stock includes a forward end 4 and a rearward end 6. The stock may be fabricated of any suitable material, which may include, without limitation, wood and synthetic resins. To the forward end 4 of the stock 2 is affixed a riser or bracket 8, suitably fabricated of a metal, such as aluminum of steel, or the like, or of a rigid synthetic resin. To this riser 8 is affixed the prods 10 and 12 that comprise the bow portion of the crossbow. These prods 10 and 12 may be affixed to the riser 8 by any suitable means, such as threaded fasteners or clamps, known to those skilled in the art. As shown more clearly in FIGS. 2 and 3, a preferred embodiment of the bow portion of the apparatus may include, adjacent the outermost extremities of the prods 10 and 12, conventional, compound-bow cam-shaped rollers 14 and 16, which carry the bow string 18 in a conventional manner.

The riser, or mount, 8 is preferably of the general configuration of an open-centered polygon, suitably a triangular or tetragonal figure, having a central opening. The riser 8 of the preferred embodiment could be characterized as having a generally triangular shape, with the prods 10 and 12 mounted to the base of the triangle and the riser mounted to the stock at an apex generally opposite that base. Alternatively, it could also be characterized as a generally tetragonal shape, in plan view, with the prods 10 and 12 affixed to two adjacent sides of the tetragonal figure and the riser attached to the stock at an apex of the figure generally opposite those prod-mounting portions.

As shown most clearly in FIG. 3, the center of the riser or mount 8 is open and dimensioned to receive the foot of a user. The sole of the user's foot, or shoe, preferably engages a foot engaging portion 20 of the riser or mount 8. Thus, as shown in FIG. 3, the user, generally indicated by reference numeral 22, while engaging the mount 8 with his or her foot 24, can then use both hands 26 and 28 to pull the string 18 back toward a position in which the sting may be cocked in a conventional manner known for crossbows. In this manner, the user 22 can use his or her foot 24 to steady the crossbow against the ground or other surface, if desired, while pulling the string 18 back for cocking. By having the foot claw inset, rearwardly of the center portion of the bow formed by the prods 10 and 12, the effective length of the overall crossbow experienced by the user, is shorter than if the foot stirrup were placed forward of the bow. This arrangement facilitates cocking of the apparatus, especially by persons of shorter stature.

While the foregoing describes a preferred embodiment of the apparatus of this invention, it is understood that such description is illustrative only of the principles of this invention and is not to be considered limitative thereof. Because numerous variations and modifications of the present invention will readily occur to those skilled in the art, the scope of this invention is to be limited solely by the claims appended hereto.

What is claimed is:

1. A crossbow comprising a bow, a stock having opposed longitudinal ends, including
a forward end to which is mounted said bow, and
a rearward end for engaging the shoulder of a user, and a foot stirrup mounted to said stock forward end and being interposed between said stock forward end and said bow, such that a user's foot is insertable into said stirrup to support the crossbow for cocking.

2. The crossbow of claim 1 wherein said foot stirrup comprises a mount to attach said bow to said stock forward end.

3. The crossbow of claim 2 wherein said bow comprises two bow prods mounted to said bow mount.

4. The crossbow of claim 3 wherein said bow mount has the general configuration of an open-centered polygon, with said bow prods mounted to a portion of said polygon and the stock forward end mounted to an apex of said polygon generally opposite said prod-mounting portion.

5. The crossbow of claim 4 wherein said open center of said mount is dimensioned to receive the foot of a user, whereby the bow mount serves as the foot stirrup positioned rearwardly of the bow.

* * * * *